US005253561A

United States Patent [19]

Wynn

[11] Patent Number: 5,253,561

[45] Date of Patent: Oct. 19, 1993

[54] ROTARY BUTT CUTTING APPARATUS

[76] Inventor: Harry Wynn, 2051 Merchants Gate, Unit 13, Oakville, Ontario, Canada, L6M 3H6

[21] Appl. No.: 774,344

[22] Filed: Oct. 10, 1991

[51] Int. Cl.[5] ..... B41J 11/70; B26D 1/62

[52] U.S. Cl. ..... 83/674; 83/346; 83/698

[58] Field of Search ..... 83/343, 344, 345, 346, 83/347, 665, 673, 674, 698; 76/107.8

[56] References Cited

U.S. PATENT DOCUMENTS 3,954,034 5/1976 Broderick ..... 83/346
3,989,077 11/1976 Humbert ..... 83/698
4,004,479 1/1977 Bodnar ..... 83/345
5,027,509 7/1991 Barben et al. ..... 83/343

*Primary Examiner*—Hien H. Phan
*Attorney, Agent, or Firm*—R. Craig Armstrong

[57] ABSTRACT

A cutting anvil assembly for use in butt cutting applications typically used in connection with self-adhesive label stock. The cutting anvil is ground to a precise outer diameter against which cutting blades of a precise height are secured by means of trapezoidal blocks. Rapid and simple changes of cutting blades are accomplished by simply setting the blade in place against the anvil and securing the blades in place between alternately semi-permanent and removable blocks. Adjustments of cutting depth to accommodate stock with different weight backings are also accomplished quickly and easily by positioning shims beneath the blades.

3 Claims, 3 Drawing Sheets

ROTARY BUTT CUTTING APPARATUS

BACKGROUND OF THE INVENTION

1. Field of the Invention

This invention relates to apparatus for the printing and labelling industry, and in particular relates to a new butt cutting apparatus for use with rotary presses.

2. Description of the Prior Art

Rotary butt cutters are widely used in the printing and label stock industry in connection with label stock that is supplied with pressure sensitive adhesive and is attached to a releasable liner. Butt cutters are used to cut through label stock without cutting through the releasable liner attached to such material. This task requires high precision as only slightly improper cut depth results in either the labels not separating from the matrix, or in the label separating from the matrix but remaining affixed to the liner. Either scenario will typically cause malfunctioning of most automatic labelling machines.

There are two main types of apparatus currently used for butt cutting. The most common type of equipment makes use of two cooperating rollers or anvils, one of which is the cutting anvil and the other is a roller anvil against which the cutting anvil bears as the stock is cut. The cutting anvil is provided as an engraved die. These engraved dies do offer the high degree of precision required in the butt cutting operation. The use of engraved dies however is extremely expensive as a different die is required for each configuration and size of label stock to be cut. This requires that a substantial investment in tooling be made as several different dies must b=kept available for different tasks. The dies are also susceptible to damage and wear. If even one cutting edge of the die is damaged the entire die must be discarded. In normal conditions a die will also wear and become dull and must be sharpened. Typically, a die can be sharpened two or three times and then it must be discarded. Thus, while providing the required degree of accuracy for the butt cutting process, engraved dies as a cutting means are extremely expensive as an initial investment and as an ongoing expense.

The other type of standard equipment used for butt cutting operations also employs two cooperating anvils, one as a cutting anvil and the other as a bearer anvil. The main difference in this type of equipment is that the cutting apparatus is not permanently affixed to the anvil as with the engraved dies, but is provided by blades which are removably secured onto the cutting anvil. Most typically, this type of equipment is standard sheeting (cutting) or perforating equipment which is adapted to be used for the butt cutting operation. Although most manufacturers of sheeting or perforating equipment do not recommend it for butt cutting purposes as it typically cannot generate the required precision, it is often used because it is much less expensive than having separate engraved dies for each different configuration of material that is to be cut. The cutting edge of the blades and the surface of the cooperating anvil normally rotate at the same speed, and the stock is cut as the blades move in and out of engagement with the anvil surface. It is desired that the stock be cut as cleanly and accurately as possible. In typical machines, there is a need to replace blades frequently as any blade damage or significant blade wear will result in improper depth cuts resulting in the label stock not being cut through or in the label stock and the backing both being cut through.

As such, a substantial amount of time is spent replacing worn or damaged blades.

In conventional rotary butt cutting apparatus utilizing replaceable blades, blade replacement is a very time consuming operation. The blades are set into slots or grooves which are milled into the surface of the cutting anvil. The blades are secured into position in the grooves by an appropriate securing means, typically being set screws. As it is virtually impossible to machine the grooves in the anvil to the required precision, it is necessary to "shim" the blades to achieve correct depth adjustment. When changing a blade the new blade is again loosely set into place and the anvil rotated so that the precise depth adjustment can be made. Once the correct height of the blade has been determined the height of the blade is then maintained by placing the shims under the blade. The blade is then tightened into its final cutting position. As stated, these procedures are very time consuming and result in considerable down time for the presses.

The present invention is directed to overcoming these and other difficulties inherent in the prior art. In the present invention a cutting anvil is provided with a removable cutting apparatus, which does not contain grooves into which the blades are secured. The present invention utilizes a cutting anvil which has a precision ground outer diameter against which the blades are secured by means of block assemblies. The height of each blade is ensured to be identical by having the blades precision ground to the same height prior to their installation onto the cutting anvil. Blade replacement can therefore be accomplished in a much shorter time than in conventional apparatus, as the new blades are simply set against the cutting anvil and immediately secured into place. This results in less set up time in adjusting blade heights and accordingly in less down time in production.

The use of a removable cutting apparatus also eliminates the need to maintain an expensive set of engraved dies.

SUMMARY OF THE INVENTION

It is an object of the present invention to provide an improved rotary butt cutting apparatus having a removable cutting apparatus that permits quick and accurate blade replacement.

It is another object of the present invention to provide a butt cutting apparatus that provides high precision.

It is still another object of the present invention to provide a butt cutting apparatus that can operate at high speeds.

It is still another object of the present invention to provide a butt cutting apparatus that can be quickly and easily adapted to cut label stock having a variety of backing thicknesses.

Thus, in accordance with the present invention, there is provided an improved cutting anvil for use in butt cutting of stock having a precision ground outer diameter, against which cutting blades are releasably secured, the blades having been ground to an identical height.

Further features of the invention will be described or will become apparent in the course of the following detailed description.

BRIEF DESCRIPTION OF THE DRAWINGS

In order that the invention may be more clearly understood, the preferred embodiment thereof will now described in detail by way of example, with reference to the accompanying drawings, in which.

DETAILED DESCRIPTION OF THE PREFERRED EMBODIMENT

Figure 3:
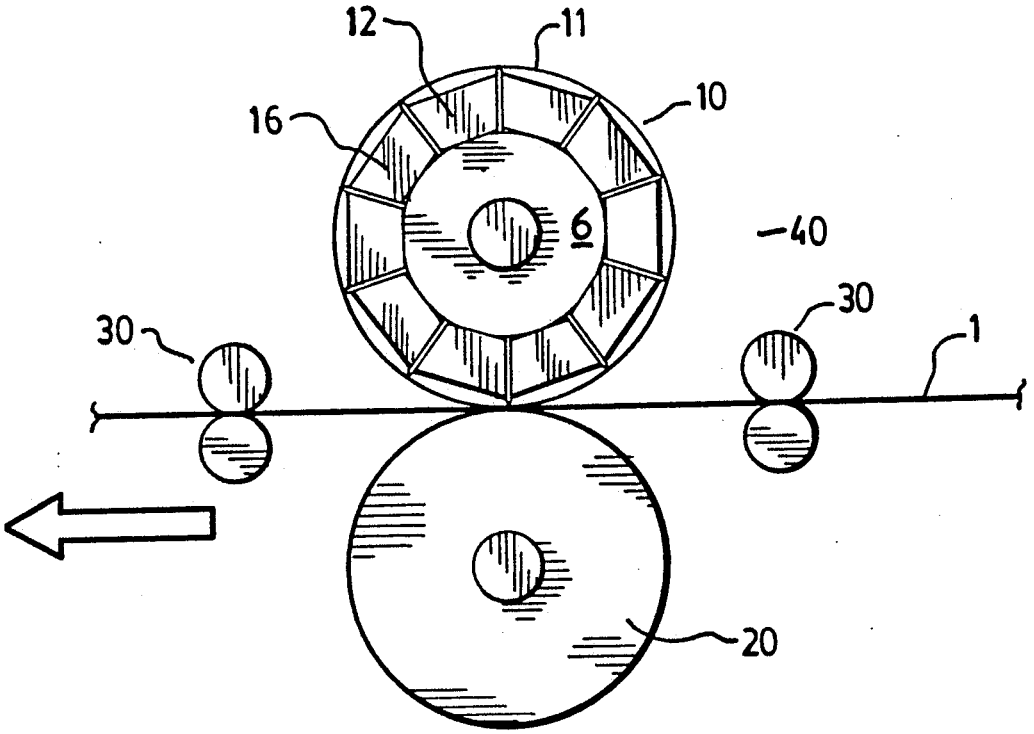
FIG. 3 is an end view showing the cooperation of the cutting anvil of FIG. 1 with the anvil roller and the relative position of the label stock therebetween.

Referring now to the drawings, and in particular to FIG. 3, rotating anvil apparatus for butt cutting operations constructed in accordance with one embodiment of the present invention is indicated at 40. The rotating anvil apparatus 40 finds particular application in butt cutting self-adhesive label stock affixed to a releasable liner.

The rotating anvil apparatus 40 includes a cylindrical anvil roller 20 and a cutting roller 10. The cutting roller 10 can be placed below the anvil roller 20 or alternatively can be placed above the anvil roller 20 as shown in FIG. 3. Typically, the cutting and anvil rollers are vertically positioned relative to each other so that the longitudinal axes of the cutting roller 10 and the anvil roller 20 are positioned in the same normal vertical plane, although that is not essential. The label stock 1 or other material to be butt cut passe between the cutting and anvil rollers, fed by feed rollers 30.

The diameter of the body 6 of the cutting roller 10 is precision ground to a tolerance of +0.0002/0.0000 of an inch. It is also essential that the body 6 be machined so that it is almost perfectly concentric between centers. The material chosen for the body is industry standard tool steel which is chrome-hardened.

Figure 1:
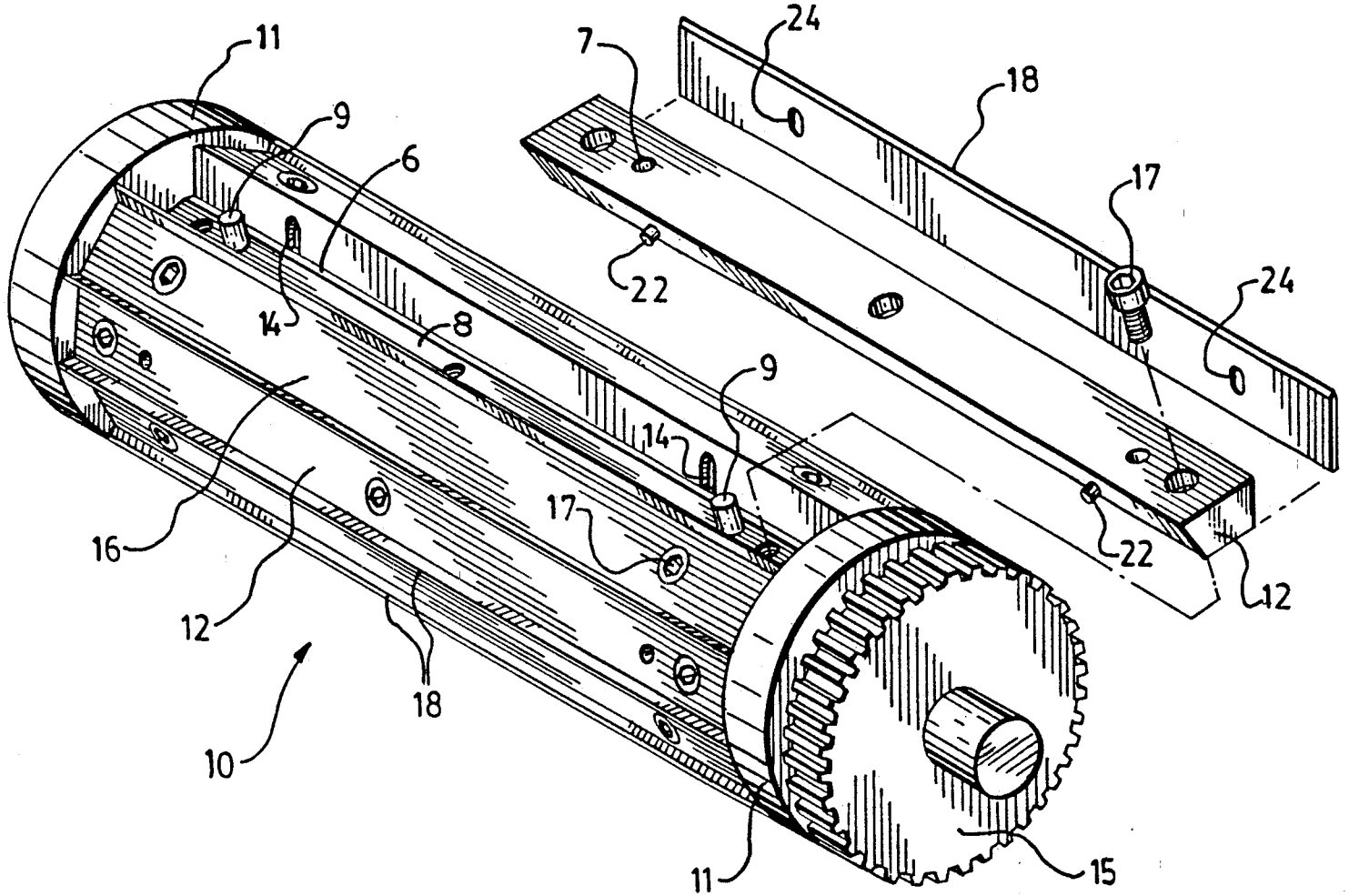
FIG. 1 is a perspective view, partially exploded, of the cutting anvil, showing the relationship of the anvil, blades and blade securing means in accordance with one embodiment of the, present invention.
Figure 2:
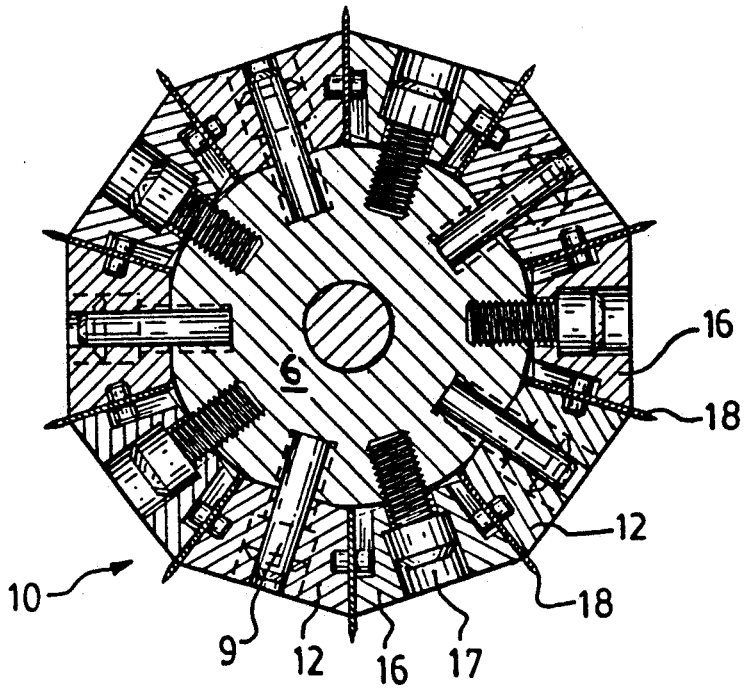
FIG. 2 is an end cross-sectional view of the cutting anvil of FIG. 1.

Referring now to FIG. 1, the body 6 is carried on a pair of upstanding frame members 11, termed bearers. These bearers 11 cooperate with similar bearers (not shown) on the anvil roller 20 so as to define a nip between the anvil and cutting rollers through which a continuous web of paper material or the like 1 passes prior to being butt cut.

The body 6 has a plurality of precision ground trapezoidal blocks releasably attached thereto. Alternate blocks are intended to remain in place semi-permanently, in which case they are referred to as fixed blocks 12. The intermediate blocks are intended to be periodically removed, e.g. for blade adjustment or replacement, in which case they are referred to as retaining blocks 16. Flats 8 are ground onto the outer surface of the body 6 under part of the fixed blocks, to provide a suitably flat surface to which the blocks may be secured.

Drive means (not shown) engage gear 15 on the cutting roller 10 and are operatively associated with the anvil roller 20 and the cutting roller 10 to effect predetermined synchronized rotation relative to each other in opposite rotational directions and in timed relation to the surface speed of the material 1 as it is fed into the nip between the anvil and the cutter rollers.

The total number of retaining blocks 16 in the embodiment as described and shown in FIG. 1 is ten. Each block is of identical dimensions, and they are spaced in an equidistant manner around the outer periphery of the body 6.

Each retaining block 16 in the embodiment illustrated is secured to the body 6 by appropriate securing means. The embodiment illustrated in FIG. 1 utilizes at least two machine bolts 17 which extend through appropriately dimensioned holes in each retaining block 16 and into suitable threaded bores in the body 6. Machine bolts 17 are of the Allen key type. Each retaining block typically extends nearly the entire distance between the bearers on the body 6.

Each fixed block 12 in the embodiment illustrated is also secured to the body 6 by means of cap screws 17. In the case of fixed blocks, three cap screws are used instead of two, so as to permit simple visual identification by the press operator. Fixed blocks 12 are also located in exact position on the outer periphery of the body 6 by two dowels 9 extending radially outwardly from the surface of the body 6. These dowels 9 line up with two jig-drilled dowel holes 7 located in the fixed blocks 12. Hence the positioning of the fixed blocks is crucial and once it is achieved in the original set up of the cutting roller 10, it is not altered. The exact positioning is used to ensure that the exact distance is maintained between butt cuts. Shims positioned underneath the fixed blocks can be used to adjust the distance between butt cuts if necessary.

Blades 18 can be secured in the manner described below, the number of blades being dependent upon the desired mode of operation of butt cutting and the desired spacing between cuts on the material 1. Blades 18 may be retained in the correct horizontal position against the retaining block 16 by optional retaining pins 22. Blades 18 then have at least two holes 24, each hole being slightly elongated in the vertical direction, so that the blades can register properly against the precisely located outer surface of the body 6. The retaining blocks 16 are provided with slots 14 to provide space to accommodate the pins.

FIG. 1 actually shows a fixed block 12 exploded from the apparatus. In actuality, the retaining blocks 16 on either side of the fixed block would have to be removed before the fixed block could be installed.

Blades 18 are normally made of suitable knife steel in flat strips bevelled and sharpened along one edge. The opposite edge of the blades 18 are ground by the operator so as to provide blades with a consistent and precise height. Blades 18 may be of the typical straight edge variety for straight butt cutting applications or may be of saw tooth or other shape for "perforated" butt cutting o other applications.

The retaining blocks 16 retain the blades by forcing them against the fixed blocks. It follows that there should be a slight gap between the bottom of the retaining blocks and the body 6, to allow the retaining blocks to be torqued into position to secure the blades, without "bottoming out" prior to sufficient retention force being achieved.

Blade replacement in the apparatus of the invention is extremely simple and accurate. To replace a worn or damaged blade, the operator first removes the cap screws 17 which secure the retaining block 16 to the body 6. The retaining block is then removed from the body. The blade 18 is then removed from the retaining pins 22 on the fixed block 12 and a new blade is put in place. The action of tightening the retaining blocks not only forces the blades against the fixed blocks, but also forces them down against the outer surface of the body 6. Since that outer surface is precisely located, and since the height of the blades is precise, the position of the cutting edge is also very precise. One explanation for this is that it is much easier to obtain precision of the external surface of the body than it is t obtain a groove a precise depth as required by the prior art.

This entire process takes only a fraction of the time that it previously took to accurately replace blades located in milled-slot type cutting anvils. It is also of course much simpler and less expensive than having to send an engraved die back to the engravers for resharpening or even having to order a new die if the die cannot be resharpened.

Figure 4:
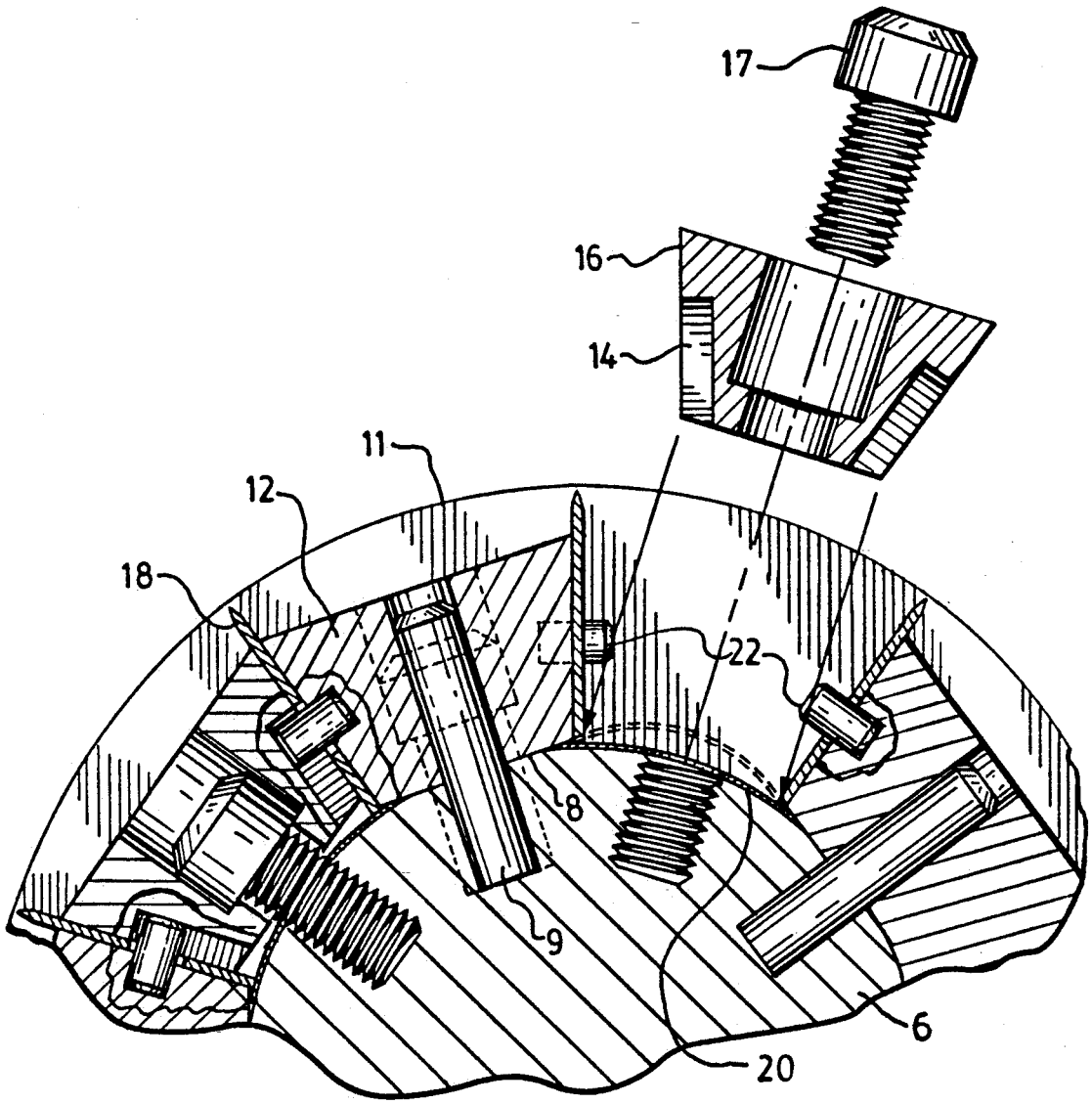
FIG. 4 is a close-up cross-sectional view corresponding to FIG. 2.

If minute adjustments in the height of the blades are desired, e.g. to adjust for different weight (thickness) of backing paper, the adjustments can be achieved very simply by using shim strips 20 as shown in FIG. 4. Because the flat area 8 beneath each fixed block does not cover the full radius of the fixed block, small gaps are left under each edge of the fixed blocks. The shim strips can be flexed as shown in dotted lines, and then snapped into position against the outer surface, extending into the gaps so that they are definitely beneath the blades.

It will be appreciated that the above description related to the preferred embodiment by way of example only. Many variations on the invention will be obvious to those knowledgeable in the field, and such obvious variations are within the scope of the invention as described and claimed, whether or not expressly described.

It should also be obvious that the invention could be used for other than butt cutting, e.g. for sheeting or perforating. These applications do not require quite the precision which butt cutting requires and for which the invention is particularly advantageous. However, the invention is nevertheless useful for such other applications, both for precision and for the ease with which blades may be changed.

I claim:

1. Cutting apparatus comprising:

a cutting roller having a cylindrical body with a generally smooth surface carried between a pair of coaxial bearer rolls;

an even-numbered plurality of trapezoidal blocks fastenable to said body so as to each run longitudinally along the circumference of said body over a substantial portion of the distance between said bearer rolls with parallel surfaces thereof arranged generally tangential to said body, and angled sides thereof being directed substantially radially, alternate ones of said blocks being intended to remain in place semi-permanently, the other said blocks being intended to be periodically removed;

a plurality of elongated blades of fixed height having a bass edge and an opposite cutting edge parallel to said base edge, said base edge registering against said body with said blades projecting radially outwardly from said body between said trapezoidal blocks;

fastening means for securing said alternate ones of said trapezoidal blocks against said body; and fastening means for forcing said other trapezoidal blocks inwardly towards said body to thereby force the bases of said blades against said body and to anchor said blades between said semi-permanent and removable blocks, said cutting apparatus further comprising flat areas which are machined into the outer surface of the body under said alternate ones of said trapezoidal blocks, running the length of said blocks, to thereby provide a suitably flat surface to which the blocks may be secured.

and further in which said flat areas cover only a portion of the arc subtended by said alternate ones of said trapezoidal blocks, such that small gaps are left under opposite sides of the bottoms of said blocks.

2. Cutting apparatus as recited in claim 2, in which said alternate ones of said trapezoidal blocks are precisely located by virtue of at least two dowels extending radially outwardly from the surface of the body, being accommodated in corresponding apertures in said blocks.

3. Cutting apparatus as recited in claim 1, in which said blades are positioned and anchored against axial movement by virtue of at least one pin projecting generally outwardly from each side of each said alternate ones of said trapezoidal blocks, each blade being provided with a corresponding hole to accommodate said pin, each said hole being slightly elongated in the radial direction so as not to prevent said blades from registering properly against said body.

* * * * *